United States Patent [19]

Rogahn

[11] Patent Number: 4,474,416

[45] Date of Patent: Oct. 2, 1984

[54] SHELF TABLE

[75] Inventor: Donald W. Rogahn, Grafton, Wis.

[73] Assignee: Luxor Corporation, Waukegan, Ill.

[21] Appl. No.: 386,941

[22] Filed: Jun. 10, 1982

[51] Int. Cl.[3] ..... A47B 47/03

[52] U.S. Cl. ..... 312/257 SK; 108/111; 108/153; 312/250; 312/257 R; 312/263

[58] Field of Search ..... 108/101, 111, 153, 159; 312/108, 257 R, 257 A, 257 SK, 257 SM, 263, 264, 250, 100

[56] References Cited

U.S. PATENT DOCUMENTS

| | | | |
|---|---|---|---|
| 1,782,344 | 11/1930 | Gourley | 312/257 SK |
| 2,467,377 | 4/1949 | Giegerich et al. | 312/257 SK |
| 3,964,810 | 6/1976 | Murphy | 312/257 R |
| 3,966,285 | 6/1976 | Porch et al. | 312/257 R |
| 4,128,284 | 12/1978 | King | 312/263 |
| 4,275,666 | 6/1981 | Schriever | 108/101 |

FOREIGN PATENT DOCUMENTS

| | | | |
|---|---|---|---|
| 188059 | 2/1956 | Austria | 108/153 |
| 195713 | 3/1964 | Sweden | 108/111 |

OTHER PUBLICATIONS

*AV & Microform Furniture,* Catalog No. 681, Copyright 1981, by Luxor Corporation, Waukegan, Illinois, front cover, p. 15.

*Primary Examiner*—James T. McCall
*Assistant Examiner*—Thomas A. Rendos
*Attorney, Agent, or Firm*—Wood, Dalton, Phillips, Mason & Rowe

[57] ABSTRACT

A mobile three-shelf table wherein the bottom, central and top shelves are interconnected by readily assembleable corner legs fitted to cooperating connecting portions on the shelves. The table includes wall panels partially enclosing the space between the bottom and central shelves which are mounted in the table with effectively minimum fastening structures. The panels define a front access opening. A door is hingedly mounted to one of the side panels for selectively closing the access opening. The shelves and panels define cooperating interlock structures for effectively retaining the panels in assembled relationship in the table. Straps are provided for reinforcing the mounting of the side panels to the front corner legs to provide improved strength and rigidity at the front access opening. In the illustrated embodiment, the space between the central and top shelves is open.

12 Claims, 4 Drawing Figures

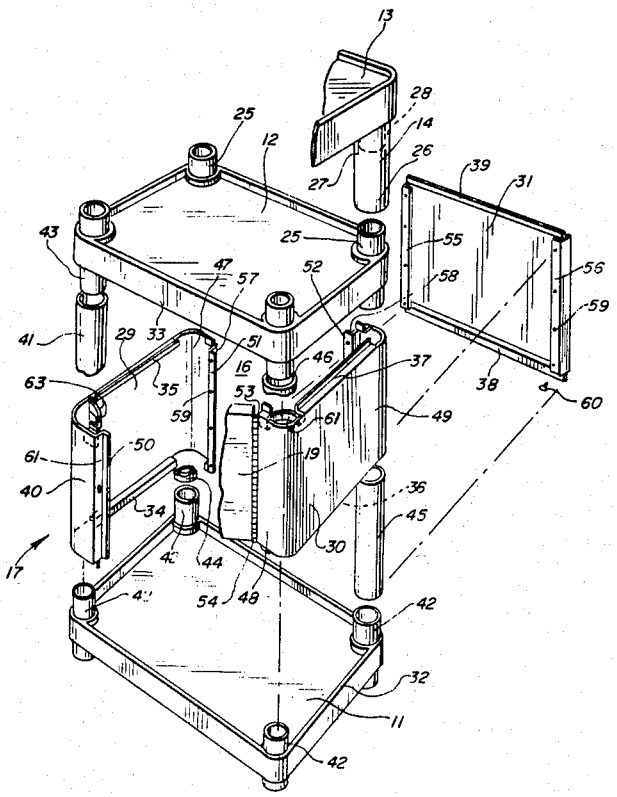

SHELF TABLE

BACKGROUND OF THE INVENTION

1. Field of the Invention

This invention relates to shelf tables and in particular to readily assembleable shelf tables.

2. Description of the Prior Art

One form of shelf table comprises a mobile audiovisual table having a tabletop top shelf for supporting audiovisual equipment, such as projectors and the like. Such audiovisual tables are conventionally referred to as AV tables and conventionally are provided with casters for facilitating movement thereof to and from desired positions. An excellent example of such mobile AV tables is that disclosed in the Catalog No. 681, published in 1981 by Luxor Corporation, of Waukegan, Illinois.

SUMMARY OF THE INVENTION

The present invention comprehends an improved shelf table illustratively comprising a mobile audiovisual table having new and improved cabinet-forming means providing a closed cabinet spaced between the bottom and central shelves thereof.

In the illustrated embodiment, the cabinet means is defined by cooperating side and rear panels mounted to the upright corner legs of the table with effectively minimum fastening means.

In the illustrated embodiment, the panels are interlocked to the shelves by cooperating interlocking wall portions.

In the illustrated embodiment, strap means are provided for rigidifying the mounting of the side panels to the front corner legs to provide improved strength in the mounting of a closure door in the cabinet portion of the table for selectively closing a front access opening defined by the panels.

The side panels are provided with front and rear edge portions partially encircling the corner legs between the bottom and central shelves, the edge portions cooperating with the interlock means in effectively retaining the panels in assembled relationship in the table.

Suitable offset flanges are provided on the rear edge portions of the side panels and the side edge portions of the rear panel for facilitated securing of the rear panel to the side panels in the assembled arrangement of the table.

The shelves and legs are provided with cooperating post and socket means permitting ready, positive assembly of the table structure in a novel and simple manner.

The table structure of the present invention is extremely rigid and strong, notwithstanding the simplified assembly arrangement thereof. The simplified arrangement permits low cost manufacture while yet assuring long, troublefree life of the table.

BRIEF DESCRIPTION OF THE DRAWING

Other features and advantages of the invention will be apparent from the following description taken in connection with the accompanying drawing wherein:

FIG. 1 is a perspective view of a shelf table embodying the invention;

FIG. 2 is a fragmentary exploded perspective view thereof;

FIG. 3 is a fragmentary enlarged perspective view illustrating in greater detail the assembly of a side panel to a front corner leg of the table; and FIG. 4 is a fragmentary enlarged vertical section taken substantially along the line 4—4 of FIG. 1.

DESCRIPTION OF THE PREFERRED EMBODIMENT

In the illustrative embodiment of the invention as disclosed in the drawing, a shelf table generally designated 10 is shown to comprise a mobile audiovisual table having a bottom shelf 11, a central shelf 12, and an upper tabletop shelf 13. Table top shelf 13 is supported in vertically spaced relationship above central shelf 12 by a plurality of corner legs 14 to define an open shelf space 15 therebetween.

The shelf space 16 between bottom shelf 11 and central shelf 12 is enclosed by a cabinet generally designated 17 defining a front access opening 18 selectively closed by a door 19. As shown in FIG. 1, the door may be provided with a suitable manipulating handle 20 and a lock 21 for retaining the door in the closed position thereof, as desired.

The bottom shelf is provided with a plurality of depending corner supports 22 comprising downwardly opening sockets formed integrally with the shelf 11 for receiving suitable pin mounting means 23 of a corresponding plurality of wheeled casters 24.

As best seen in FIG. 2, central shelf 12 is provided with a plurality of upstanding corner posts 25 adapted to be received in the lower end 26 of a corresponding plurality of the legs 14, which comprise short, tubular legs. The legs 14, as seen in FIG. 2, further define upper end portions 27 receiving depending posts 28 on the underside of the top shelf 13. The tubular legs 14 are fitted snugly to the posts 25 and 28 to effectively retain the shelves 12 and 13 in the desired assembled spaced relationship illustrated in FIG. 1.

As illustrated in FIG. 2, cabinet portion 17 of the table 10 is defined by a first, or left, side panel 29, a second, or right, side panel 30, and a rear panel 31. As shown in FIG. 2, bottom shelf 11 defines a peripheral upstanding wall portion 32. Central shelf 12 defines a similar depending peripheral wall portion 33. As illustrated in FIGS. 2 and 4, side panel 29 is provided with a first, downturned flange 34. As best seen in FIG. 4, the flange projects downwardly inwardly adjacent the upstanding peripheral wall 32 of the bottom shelf 11, and thus, retains the side panel against outward displacement thereat.

The upper edge of the side panel 29 is provided with a complementary upturned flange 35, which cooperates similarly to have interlocked association with the downturned wall 33 of the central shelf 12.

Right side panel 30 is provided similarly with a second downturned flange 36 on its lower edge portion and a second upturned flange 37 on its upper edge portion for similar interlocked association with the bottom shelf flange 32 and central shelf flange 33.

As further shown in FIG. 2, rear panel 31 is provided with a third downturned flange 38 on its lower edge and a third upturned flange 39 on its upper edge for interlocked association with the walls 32 and 33.

With further reference to FIG. 2, side panel 29 further defines a turned first front edge portion 40 extending about the left front corner leg 41. The tubular corner leg is fitted at its lower end to an upstanding post 42 on shelf 11 and at its upper end to a depending post 43 on the shelf 12. As seen in FIG. 2, shelf 11 is provided with such upstanding posts 42 at each of the four corners thereof and shelf 12 is provided similarly with four depending posts 43 at the four corners thereof to cooperate with four such corner legs 41, 44, 45 and 46, respectively.

Side panel 29, as seen in FIG. 2, further defines a turned rear edge portion 47 which extends about the rear leg 44. Similarly, side panel 30 defines a front turned edge portion 48 extending around right front corner leg 46, and a rear turned edge portion 49 extending around right rear corner leg 45.

A first distal flange 50 is provided on front turned edge portion 40 of panel 29 and a second distal flange 51 is provided on the turned rear portion 47 of panel 29.

Rear turned portion 49 of panel 30 is provided with a distal flange 52 and front turned edge portion 48 of panel 30 is provided with a distal flange 53. As illustrated in FIG. 2, each of the distal flanges 50, 51 and 52 comprises an L-shaped flange, whereas flange 53 is defined by a single inturned portion adapted to mount a hinge 54.

Rear panel 31 defines a first, left side edge flange portion 55 and a second right edge flange portion 56 which are adapted to be received in the mounting spaces 57 and 58 defined respectively by the L-shaped flanges 51 and 52. As shown, each of flanges 51, 52, 55 and 56 is provided with screw holes 59 for receiving suitable threaded fastening screws 60 for securing the rear panel to the side panel flanges 51 and 52 to extend across the rear of the shelf space 16, with the downturned flange 38 and upturned flange 39 of the rear panel interlocked with the walls 32 and 33 of the shelves 11 and 12, respectively.

Turned distal flange 50 of the front edge portion 40 of panel 29 effectively defines a jamb space 61 for receiving the distal end 62 of door 19 from the closed position illustrated in FIG. 1.

As illustrated in greater detail in FIG. 3, the front corner portions of the side panels are further provided with arcuate straps 63 subjacent the upturned top flanges thereof for cooperating with the turned edge portion, such as edge portion 40 of side panel 29, and fully encircling the leg and, thus, cooperating with the interlocking flanges of the panels and shelves in effectively positively securing the cabinet structure in the table assembly. As shown in FIG. 2, a strap 63 is provided in association with each of the front corner portions 40 and 48 of the panels 29 and 30, respectively. As shown, the straps are provided at the top of the side panels.

The shelf table may be readily assembled from a knocked-down arrangement. Illustratively, the top portion of the table may be assembled first by placing the top shelf 13 in an upside down disposition on a support and suitably installing the short legs 14 on the corner posts 28 thereof. The center shelf 12 is then installed on the upwardly projecting short legs 14 in an inverted position.

The long legs 41, 44, 45 and 46 are then installed on the upstanding posts on the inverted central shelf. The side panels are then moved downwardly with the turned edge portions extending around the upstanding long legs until the flanges 35 and 37 thereof interlock with the wall 33 projecting upwardly on the inverted central shelf. This brings the straps 63 to closely adjacent the upwardly facing bottom surface of the central shelf.

The rear panel is then installed between the turned rear edge portions 47 and 49 of the side panels, with the flange 39 thereof interlocking with the wall 33 of the central shelf. Suitable screws 60 are then installed to secure the rear panel in the assembly.

Bottom shelf 11 is now installed on the upwardly projecting upper ends of the long legs 41, 44, 45 and 46 by the insertion of the posts 42 thereinto.

The thusly assembled cabinet table is then turned upright and the hinge previously attached to the door 19 secured to the flange 53 of side panel 30.

Where the table is provided with the caster 24, the casters may be installed in the depending posts 22 by insertion of the pin mounting means 23 thereinto, as illustrated in FIG. 1, to complete the assembly.

Thus, the cabinet table 10 may be readily assembled with an effectively minimum use of separate fasteners. The encircling relationship of the sidewall turned edge portions to the upright legs, the novel interlocked association of the cabinet side and rear panels with the underlying shelf 11 and overlying shelf 12, the positive retaining means of the straps 63, and the snug fitting of the legs in the cooperating posts provided integrally in the shelves assures a simple, effectively postive assembly of the table with minimum effort and time. The assembled table, however, is extremely rigid and strong and provides long, troublefree life, such as in use thereof as an audiovisual cabinet table.

The foregoing disclosure of specific embodiments is illustrative of the broad inventive concepts comprehended by the invention.

I claim:

1. In a shelf table having a tabletop, and upright front and rear corner legs, said legs defining an upper portion supporting the tabletop and a lower portion, the improvement comprising:

a bottom shelf mounted to said lower portion of the legs, said shelf defining upwardly extending peripheral wall means;

means underlying said tabletop defining downwardly extending wall means;

a first side panel having a turned first front edge portion extending about one of said front legs, a turned first rear edge portion extending about the rear leg rearwardly of said one front leg, a first distal flange on said front edge portion defining forwardly thereof a forwardly opening jamb space, a second distal flange on said rear edge portion defining rearwardly thereof a rearwardly opening first mounting space, first downturned flange means projecting downwardly inwardly adjacent said peripheral wall means of the bottom shelf for preventing outward displacement of said first panel means thereat, and first upturned flange means projecting upwardly inwardly adjacent said downwardly extending wall means for preventing outward displacement of said first panel means thereat;

a second side panel having a turned second front edge portion extending about another of said front legs, a turned second rear edge portion extending about the rear leg rearwardly of said another front leg, a third distal flange on said second front edge portion defining forwardly thereof a forwardly opening hinge space, a fourth distal flange on said second rear edge portion defining rearwardly thereof a rearwardly opening second mounting space, second downturned flange means projecting downwardly inwardly adjacent said peripheral wall means of the bottom shelf for preventing outward displacement of said second panel means thereat, and second upturned flange means projecting upwardly inwardly adjacent said downwardly extending wall means for preventing outward displacement of said second panel means thereat;

a rear panel having a first side edge portion received in said first mounting space and an opposite second side edge portion received in said second mounting space, third downturned flange means projecting downwardly forwardly adjacent said peripheral wall means of the bottom shelf for preventing outward displacement of said rear panel thereat, and third upturned flange means projecting upwardly forwardly adjacent said downwardly extending wall means for preventing outward displacement of said rear panel thereat;

means for securing said first side edge portion of the rear panel to said second distal flange of the first side panel;

means for securing said second side edge portion of the rear panel to said fourth distal flange of the second side panel;

a door having a distal edge portion removably received in said jamb space and an opposite mounting edge portion received in said hinge space; and hinge means for hingedly mounting said edge portion of the door to said front edge portion of said second side panel, said first distal flange of the first side panel defining a stop surface for preventing movement of said distal edge of the door rearwardly beyond said jamb space.

2. The shelf table of claim 1 wherein a center shelf is provided on said legs spaced subjacent said tabletop, said means defining said downwardly extending wall means being carried by said center shelf.

3. The shelf table of claim 1 wherein a first strap element is provided on said second side panel extending inwardly about said another of the front legs and cooperating with said turned front edge portion thereof in fully encircling said another of the front legs for preventing displacement of the hinge means away from said another of the front legs.

4. The shelf table of claim 1 wherein a first strap element is provided on said second side panel extending inwardly about said another of the front legs and cooperating with said turned front edge portion thereof in fully encircling said another of the front legs for preventing displacement of the hinge means away from said another of the front legs, and a second strap element is provided on said first side panel extending inwardly about said one of the front legs and cooperating with said turned front edge portion thereof in fully encircling said one of the front legs for preventing displacement of the jamb space away from said one of the front legs.

5. The shelf table of claim 1 wherein a first strap element is provided on said second side panel extending inwardly about said another of the front legs and cooperating with said turned front edge portion thereof in fully encircling said another of the front legs for preventing displacement of the hinge means away from said another of the front legs, and a second strap element is provided on said first side panel extending inwardly about said one of the front legs and cooperating with said turned front edge portion thereof in fully encircling said one of the front legs for preventing displacement of the jamb space away from said one of the front legs, said strap elements being provided at an upper portion only of the side panels.

6. The shelf table of claim 1 wherein said legs define tubular lower end portions, said bottom shelf being provided with upstanding corner posts, said lower end portion being fitted to said posts.

7. The shelf table of claim 1 wherein said legs define tubular lower end portions, said bottom shelf being provided with upstanding corner posts, said lower end portion being fitted to said posts, said table further including a center shelf spaced subjacent said tabletop and provided with downwardly extending corner posts, said legs defining tubular upper end portions fitted to said downwardly extending corner posts for supporting said center shelf in preselected spaced relationship above said bottom shelf.

8. The shelf table of claim 1 wherein a center shelf is provided on said legs spaced subjacent said tabletop, said door extending vertically removably between said bottom and center shelves for selectively closing the space defined by said shelves, side panels and rear panel.

9. The shelf table of claim 1 wherein at least a portion of said flange means on each of said side panels is provided on a turned edge portion thereof.

10. The shelf table of claim 1 wherein at least a portion of said flange means on each of said side panels is provided on each of the turned edge portions thereof.

11. The shelf table of claim 1 wherein at least a portion of said flange means on each of said side panels is provided on each of a top and bottom portion of each of the turned edge portions thereof.

12. The shelf table of claim 1 wherein said downturned flange means are larger than said upturned flange means.

* * * * *